US005548185A

United States Patent [19]

Kumar et al.

[11] Patent Number: 5,548,185

[45] **Date of Patent: *Aug. 20, 1996**

[54] TRIODE STRUCTURE FLAT PANEL DISPLAY EMPLOYING FLAT FIELD EMISSION CATHODE

[75] Inventors: Nalin Kumar, Austin; Chenggang Xie, Cedar Park, both of Tex.

[73] Assignee: Microelectronics and Computer Technology Corporation, Austin, Tex.

[ * ] Notice: The term of this patent shall not extend beyond the expiration date of Pat. No. 5,543,684.

[21] Appl. No.: 458,854

[22] Filed: Jun. 2, 1995

Related U.S. Application Data

[63] Continuation of Ser. No. 993,863, Dec. 23, 1992, abandoned, which is a continuation-in-part of Ser. No. 851,701, Mar. 16, 1992, abandoned.

[51] Int. Cl.[6] ..... H01J 19/24

[52] U.S. Cl. ..... 313/495; 313/497; 313/308; 313/306; 313/346 R; 313/311

[58] Field of Search ..... 313/267, 292, 313/495, 496, 497, 308, 309, 336, 351, 306, 311, 346 R; 315/169.4; 345/41, 37, 60, 75

[56] References Cited

U.S. PATENT DOCUMENTS

| | | | |
|---|---|---|---|
| 3,855,499 | 12/1974 | Yamada et al. | 313/309 X |
| 3,947,716 | 3/1976 | Fraser, Jr. et al. | 313/336 |
| 3,970,887 | 7/1976 | Smith et al. | 313/309 |
| 4,008,412 | 2/1977 | Uuito et al. | 313/309 |
| 4,075,535 | 2/1978 | Genequand et al. | 313/422 |
| 4,139,773 | 2/1979 | Swanson | 313/351 |
| 4,164,680 | 8/1979 | Villalobos | 313/336 |
| 4,307,507 | 12/1981 | Gray et al. | 313/309 X |
| 4,350,926 | 9/1982 | Shelton | 313/455 |
| 4,498,952 | 2/1985 | Christensen | 313/309 X |
| 4,540,983 | 9/1985 | Morimoto et al. | 313/497 X |
| 4,578,614 | 3/1986 | Gray et al. | 313/309 |
| 4,588,921 | 5/1986 | Tischer | 313/495 |
| 4,594,527 | 6/1986 | Genovese | 313/495 |
| 4,663,559 | 5/1987 | Christensen | 313/336 |
| 4,684,353 | 8/1987 | deSouza | 445/51 |
| 4,685,996 | 8/1987 | Busta et al. | 156/628 |
| 4,710,765 | 12/1987 | Ohkoshi et al. | 340/781 |
| 4,721,885 | 1/1988 | Brodie | 313/309 X |

(List continued on next page.)

FOREIGN PATENT DOCUMENTS

| | | |
|---|---|---|
| 2608842 | 12/1986 | France . |
| 2663462 | 6/1990 | France . |

OTHER PUBLICATIONS

Noer, Electron–Field Emission from Broad–Area Electrode *Applied Physics* A 28, 1982 pp. 1–24.

(List continued on next page.)

*Primary Examiner*—Sandra L. O'Shea
*Assistant Examiner*—Ashok Patel
*Attorney, Agent, or Firm*—Kelly K. Kordzik; Winstead Sechrest & Minick P.C.

[57] ABSTRACT

A flat panel display of a field emission type having a triode (three terminal) structure and useful as a device for displaying visual information is disclosed. The display includes a plurality of corresponding light-emitting anodes and field-emission cathodes, each of the anodes emitting light in response to emission from each of the corresponding cathodes, each of the cathodes including a layer of low work function material having a relatively flat emission surface which includes a plurality of distributed localized electron emission sites and a grid assembly positioned between the corresponding anodes and cathodes to thereby control emission levels to the anodes from the corresponding cathodes. In the preferred embodiment of the invention, the layer of low work function material is amorphic diamond film. The grid assembly includes a conductive layer deposited between the plurality of anodes and cathodes and over interstices between the cathodes, the conductive layer having apertures therein, the cathodes aligned with, and of the same size as, the apertures.

43 Claims, 3 Drawing Sheets

U.S. PATENT DOCUMENTS

| | | | |
|---|---|---|---|
| 4,728,851 | 3/1988 | Lambe | 313/309 |
| 4,763,187 | 8/1988 | Biberian | 313/309 X |
| 4,788,472 | 11/1988 | Katakami | 313/496 |
| 4,835,438 | 5/1989 | Baptist et al. | 313/309 |
| 4,855,636 | 8/1989 | Busta et al. | 313/336 X |
| 4,857,161 | 8/1989 | Borel et al. | 313/309 X |
| 4,857,799 | 8/1989 | Spindt et al. | 313/495 |
| 4,874,981 | 10/1989 | Spindt | 313/309 |
| 4,882,659 | 11/1989 | Gloudemans | 313/496 X |
| 4,899,081 | 2/1990 | Kishino et al. | 313/496 |
| 4,908,539 | 3/1990 | Meyer | 315/169.4 |
| 4,923,421 | 5/1990 | Brodie et al. | 445/24 |
| 4,933,108 | 6/1990 | Soredal | 252/518 |
| 4,940,916 | 7/1990 | Borel et al. | 313/306 |
| 4,964,946 | 10/1990 | Gray et al. | 313/309 X |
| 4,990,766 | 2/1991 | Simms et al. | 313/336 X |
| 5,015,912 | 5/1991 | Spindt et al. | 313/495 |
| 5,036,247 | 7/1991 | Watanabe et al. | 313/496 |
| 5,038,070 | 8/1991 | Bardai et al. | 313/309 |
| 5,055,744 | 10/1991 | Tsuruoka | 313/497 X |
| 5,063,323 | 11/1991 | Longo et al. | 313/309 |
| 5,063,327 | 11/1991 | Brodie et al. | 313/495 X |
| 5,089,742 | 2/1992 | Kirkpatrick et al. | 313/351 |
| 5,103,144 | 4/1992 | Dunham | 313/336 X |
| 5,103,145 | 4/1992 | Doran | 313/309 X |
| 5,141,460 | 8/1992 | Jaskie et al. | 313/309 X |
| 5,157,309 | 10/1992 | Parker et al. | 313/309 X |
| 5,180,951 | 1/1993 | Dworksy et al. | 315/169.4 X |
| 5,194,780 | 3/1993 | Meyer | 313/336 X |
| 5,243,252 | 9/1993 | Kaneko et al. | 313/309 |

OTHER PUBLICATIONS

Auakyan et al, Angular Characteristics of the Radiation by Ultrarelativistic Electrons in Thick Diamond Single Crystals, *Sov. Tech. Phys. Lett.* vol. 11, No. 11, Nov. 1985, pp. 574–575.

Djubua et al, Emission Properties of Spindt–Type Cold Cathodes with Different Emission Cone Material, *IEEE Transactions on Electron Devices,* vol. 38, No. 10, Oct. 1991.

Wang et al, Cold Field Emission From CVD Diamond Films Observed in Emission Electron Microscopy, Electronics Letters, vol. 27, No. 16, Aug. 1991.

Geis et al, Diamond Cold Cathode, *IEEE Electron Device Letters,* vol. 12, No. 8, pp. 456–459, Aug. 1991.

Collins et al, Thin–Film Diamond, *The Texas Journal of Science,* vol. 41, No. 4, pp. 343–358, 1989.

Collins et al, Laser Plasma Source of Amorphic Diamond, *Appl. Phys. Lett.,* vol. 54, No. 3, 16 Jan. 89 pp. 216–218.

Heidings Feldova et al, Rhodium Complexes as Catalysts for Hydrosilylation Crosslinking of Silicone Rubber, *Journal of Applied Polymer Science* vol. 30, 1985 pp. 1837–1846.

Dauanloo et al, Amorphic Diamond Films Produced by a Laser Plasma Source, *Journal Appl. Physics,* vol. 67, No. 4, 15 Feb. 1990, pp. 2081–2087.

Meyer et al, Recent Development on "Microtips" Display at Left, *Technical Digest of IUMC* 91, Nagahama 1991, pp. 6–9.

TRIODE STRUCTURE FLAT PANEL DISPLAY EMPLOYING FLAT FIELD EMISSION CATHODE

RELATED APPLICATION

This is a continuation of application Ser. No. 07/993,863 filed on Dec. 23, 1992, now abandoned, which is a continuation-in-part of Ser. No. 07/851,701, which was filed on Mar. 16, 1992, entitled "Flat Panel Display Based on Diamond Thin Films" which was abandoned in favor of U.S. patent application Ser. No. 08/343,262, which was filed on Jun. 20, 1994, now allowed.

TECHNICAL FIELD OF THE INVENTION

This invention relates, in general, to flat panel displays for computers and the like, and, more specifically, to flat panel displays that are of a field emission type using a triode (three terminal) pixel structure with flat cathode emitters in which the pixels are individually addressable.

BACKGROUND OF THE INVENTION

Field emission computer displays, in the general sense, are not new. For years there have been displays which comprise a plurality of field emission cathodes and corresponding anodes, the anodes emitting light in response to electron bombardment from corresponding the cathodes. Before entering a discussion on such displays, however, it is helpful to gain an understanding of the nature of field emission.

Field emission is a phenomenon which occurs when an electric field proximate the surface of an emission material narrows the width of a potential barrier existing at the surface of the emission material. This allows a quantum tunnelling effect to occur, whereby electrons cross through the potential barrier and are emitted from the material.

The field strength required to initiate emission of electrons from the surface of a particular material depends upon that material's "work function." Many materials have a positive work function and thus require a relatively intense electric field to bring about field emission. Some materials do, in fact, have a low, or even negative, work function and thus do not require intense fields for emission to occur. Such materials may be deposited as a thin film onto a conductor, resulting in a cathode with a relatively low threshold voltage required to produce electron emissions.

In prior art devices, it was desirable to enhance field emission of electrons by providing for a cathode geometry which focussed electron emission at a single, relatively sharp point at a tip of a conical cathode (called a micro-tip cathode). These micro-tip cathodes, in conjunction with extraction grids proximate the cathodes, have been in use for years in triode field emission displays.

For example, U.S. Pat. No. 4,857,799, which issued on Aug. 15, 1989, to Spindt et al., is directed to a matrix-addressed flat panel display using field emission cathodes. The cathodes are incorporated into the display backing structure, and energize corresponding cathodoluminescent areas on a face plate. The face plate is spaced 40 microns from the cathode arrangement in the preferred embodiment, and a vacuum is provided in the space between the plate and cathodes. Spacers in the form of legs interspersed among the pixels maintain the spacing, and electrical connections for the bases of the cathodes are diffused sections through the backing structure. Spindt et al. employ a plurality of micro-tip field emission cathodes in a matrix arrangement, the tips of the cathodes aligned with apertures in an extraction grid over the cathodes. With the addition of an anode over the extraction grid, the display described in Spindt et al. is a triode display.

Unfortunately, micro-tips employ a structure which is difficult to manufacture, since the micro-tips have fine geometries. Unless the micro-tips have a consistent geometry throughout the display, variations in emission from tip to tip will occur, resulting in unevenness in illumination of the display. Furthermore, since manufacturing tolerances are relatively tight, such micro-tip displays are expensive to make.

Another example of micro-tip cathodes is found in U.S. Pat. No. 5,038,070, which issued on Aug. 6, 1991 to Bardai et al., directed to a triode display and discloses a plurality of field emitters in the form of hollow, upstanding pointed cones or pyramids formed by a molding process. The plurality of field emitters extend from a surface of an electrically conductive layer. An electrically conductive mesh is adhered to an opposite surface of the conductive layer by a high temperature brazing process in electrical connection with the conductive layer. The mesh provides a strong metal base with good thermal conductivity for mounting. Additional elements such as a gate and anode structure may be formed on the conductive layer in alignment with the field emitters to form a field emitting triode array or the like.

A disadvantage of the field emitter structure taught in Bardai et al. is that emitter cones must be photolithographically grown, which is a very complex and expensive procedure.

Yet another triode micro-tip structure is illustrated in "Recent Developments on 'Microtips' Display at LETI," published in the Technical Digest of IVMC, Nagahama, 1991. Author R. Meyer describes a micro-tip display having two salient features: (1) cold electron emission by field effect from a large matrix array of "micro-guns" (or micro-tips) and (2) low-voltage cathodoluminescence (of a few hundred volts). Again, Meyer uses micro-tip cathodes which have the disadvantages which have been noted above.

Another patent to Spindt et al., U.S. Pat. No. 5,015,912, which issued on May 14, 1991, teaches a matrix-addressed flat panel display using micro-tip cathodes of the field emission type. Spindt et al. discloses a grid structure for use in conjunction with micro-tip cathodes.

An attribute of the invention disclosed in Spindt et al. is that it provides its matrix-addressing scheme entirely within the cathode assembly. Each cathode includes a multitude of spaced-apart electron emitting tips which project upwardly therefrom toward a face structure. An electrically conductive gate or extraction electrode arrangement is positioned adjacent the tips to generate and control electron emission from the latter. Such arrangement is perpendicular to the base stripes and includes apertures through which electrons emitted by the tips may pass. The extraction electrode is addressed in conjunction with selected individual cathodes to produce emission from the selected individual cathodes. The grid-cathode arrangement is necessary in micro-tip cathodes constructed of tungsten, molybdenum or silicon, because the extraction field necessary to cause emission of electrons exceeds 50 Mv/m. Thus, the grid must be placed close (within approximately 1 micrometer) to the micro-tip cathodes. These tight tolerances require that the gate electrodes be produced by optical lithographic techniques on an electrical insulating layer which electrically separates the gates of each pixel from the common base. Such photolithography is expensive and difficult to accomplish with the accuracy required to produce such a display, thereby raising rejection rates for completed displays. Moreover, the extraction grid taught in Spindt et al. was specifically designed to operate in conjunction with micro-tip cathodes, and not with other geometries.

The two major problems with the device disclosed in Spindt et al. are 1) formation of the micro-tip cathodes and 2) formation and alignment of the extraction electrodes with respect to the cathodes. The structure disclosed in Spindt et al. is extremely intricate and difficult to fabricate in the case of large area displays.

The prior art has been directed to micro-tip cathodes, even in view of their formidable manufacturing difficulties, because they are advantageously used with an extraction grid in a triode (three terminal) structure.

In a triode (three terminal) pixel structure, an electron extraction grid structure is interspersed between corresponding cathode and anode pairs. In the case of triode displays, the grid gives an extra control parameter which produces several advantages. First, the grid can be controlled independent of the cathodes and anodes to thereby produce independently controllable cathode-anode and cathode-grid electric fields. This allows use of a very low control voltage to be applied to the cathode-grid field to effect electron emission, while the grid-anode voltage can be very high (several hundred to several thousand volts) to thereby result in higher power efficiency of the display. This is so because the anode phosphor material can be excited by electrons falling through a greater potential and, hence, be struck by electrons having a greater kinetic energy. Second, voltages selectively applied to address and excite individual grid-anode pairs can be lower (on the order of 40 volts), thereby allowing use of more conventional electronics in drive circuitry. Finally, the lower electric field between the grid and the anode (on the order of 1–5 volts per micrometer) reduces dielectric requirements for spacer material used to separate cathode and anode assemblies. Prior art extraction grid structures were designed to cooperate with micro-tip cathodes to enhance control of electron extraction and emission.

In Ser. No. 07/851,701, which was filed on Mar. 16, 1992, now abandoned and entitled "Flat Panel Display Based on Diamond Thin Films," an alternative cathode structure was first disclosed. The Ser. No. 07/851,701 discloses a cathode having a relatively flat emission surface. The cathode, in its preferred embodiment, employs an emission material having a relatively low effective work function. The material is deposited over a conductive layer and forms a plurality of emission sites, each of which can field-emit electrons in the presence of a relatively low intensity electric field.

Flat cathodes are much less expensive and difficult to produce in quantity because the fine, micro-tip geometry has been eliminated. The advantages of the flat cathode structure was discussed at length therein. The entirety of that application, which is commonly assigned with the present invention, is incorporated herein by reference.

A relatively recent development in the field of materials science has been the discovery of amorphic diamond. The structure and characteristics of amorphic diamond are discussed at length in "Thin-Film Diamond," published in the Texas Journal of Science, vol. 41, no. 4, 1989, by C. Collins et al., the entirety of which is incorporated herein by reference. Collins et al. describe a method of producing amorphic diamond film by a laser deposition technique. As described therein, amorphic diamond comprises a plurality of micro-crystallites, each of which has a particular structure dependent upon the method of preparation of the film. The manner in which these micro-crystallites are formed and their particular properties are not entirely understood.

Diamond has a negative electron affinity in the (111) direction. Thus n-type diamond has a negative work function. That is, only a relatively low electric field is required to distort the potential barrier present at the surface of diamond. Thus, diamond is a very desirable material for use in conjunction with field emission cathodes. In fact, the prior art has employed diamond films to advantage as an emission surface on micro-tip cathodes. However, the prior art has failed to recognize that amorphic diamond, which has physical qualities which differ substantially from other forms of diamond, makes a particularly good emission material. Ser. No. 07/851,701, now abandoned, was the first to disclose use of amorphic diamond film as an emission material. In fact, in the preferred embodiment of the invention described therein, amorphic diamond film was used in conjunction with a flat cathode structure to result in a radically different field emission cathode design. The micro-crystallites present in the amorphic diamond film are more or less disposed to function as electron emission sites, depending upon their individual structure. Therefore, over the surface of a relatively flat cathode emission surface, amorphic diamond micro-crystallites will be distributed about the surface, a percentage of which will act as localized electron emission sites.

The prior art has been entirely directed to triode flat panel displays based on micro-tip cathodes constructed of molybdenum, tungsten, silicon or similar materials. The prior art has failed to provide a matrix-addressable flat panel display that is 1) relatively simple in design, 2) relatively inexpensive to manufacture and 3) uses a triode (three terminal) pixel structure employing a cathode which has a relatively flat emission surface comprising a plurality of distributed localized electron emission sites.

The prior art has also failed to address the problem of providing an appropriate grid structure for use in conjunction with flat cathodes.

The purpose of the present invention is to build on the idea of depositing amorphic diamond film on the surface of relatively flat field emission cathodes, by providing a triode display structure employing a novel extraction grid proximate the flat cathodes to cause emission therefrom.

SUMMARY OF THE INVENTION

The present invention relates to a flat panel display arrangement which employs the advantages of a luminescent phosphor of the type used in CRTs, while maintaining a physically thin profile. Specifically, the present invention provides for a flat panel display comprising (1) a plurality of corresponding light-emitting anodes and field-emission cathodes, each of the anodes emitting light in response to emission from each of the corresponding cathodes, each of the cathodes including a layer of low work function material having a relatively flat emission surface comprising a plurality of distributed localized electron emission sites and (2) a grid assembly interspersed between the corresponding anodes and cathodes to thereby control emission levels to the anodes from the corresponding cathodes, the grid assembly having apertures therein, the apertures having diameters equal to that of corresponding cathodes, such that the cathodes do not lie under the grid assembly.

In other words, the flat panel display is of a field emission type using a triode (three terminal) pixel structure. The display is matrix-addressable by using grid and cathode assemblies arranged in strips in a perpendicular relationship whereby each grid strip and each cathode strip are individually addressable by grid and cathode voltage drivers, respectively. Effectively, a "pixel" is formed at each intersection of a grid strip and a cathode strip. The result is that each pixel within the display may be individually illuminated.

The grid strips themselves have a novel construction which allows them to operate with flat cathodes. More specifically, the grid strips comprise a substrate, preferably of $SiO_2$, upon which is deposited a conductive layer, preferably of a metal. The conductive layer is etched to produce apertures therein, the apertures corresponding to particular cathode-anode pairs, edges of the apertures being located substantially above edges of corresponding cathodes.

The cathode assembly comprises a plurality of flat cathodes are, in the preferred embodiment of the present invention, photolithographically patterned either (1) through the apertures in the grid or (2) in alignment with the apertures in the grid. Each cathode comprises a conductive material deposited over a substrate and a resistive material deposited over the conductive material. A thin film of low effective work function is then deposited over the resistive layer. The resistive layer provides a degree of electrical isolation between various subdivisions of the cathode strips.

The anode assembly consists of a conductive material (such as indium-tin oxide in the preferred embodiment) deposited over a substrate with a low energy phosphor (such as zinc oxide in the preferred embodiment), deposited over the conductive layer. In an alternative embodiment of the present invention, a plurality of red, green and blue phosphors can be deposited over the conductive layer to provide a color display.

The resulting anode assembly and cathode assemblies are joined together with a peripheral glass frit seal onto a printed circuit board. Proper spacing between the assemblies is maintained by spacers consisting of either glass fibers or glass balls or a fixed spacer produced by typical deposition technology. The assemblies are hermetically sealed and a vacuum drawn within the space between the anode and cathode assemblies via an exhaust tube. Systems for maintaining vacuums within such structures are well known in the art. Residual gases within the vacuum are collected together by a device called a getter.

The individual rows and columns of grid strips and cathode strips are externally accessible by flexible connectors provided by typical semiconductor mounting technology. These connectors are attached to grid and cathode drivers so as to provide the addressability of each pixel within the display.

An individual pixel is illuminated when the electrical potential difference between portions of a cathode and grid strip corresponding to that pixel is sufficient to extract electrons from the emission material coating the cathode, thereby causing emission of electrons from the cathode, through the control grid and toward the anode. As the electrons travel to the anode, they strike the low energy phosphor material, thereby producing light.

In a triode display, the gap between the cathode and grid is on the order of 1 micrometer. Because the spacing is so close, only 40 volts or so is required to cause emission. Commercially available devices are available in the prior art to switch 40 volts. These voltage drivers are also referred to as grid drivers and cathode drivers. A pixel is addressed and illuminated when the required driver voltage is applied to a corresponding grid strip and cathode strip resulting in emission of electrons from that portion of the cathode strip adjacent to the grid strip. Electrons are not emitted in a particular pixel area if only the corresponding cathode strip or corresponding grid strip is driven by the required driver voltage since the required threshold potential between the cathode and grid is not achieved.

The present invention has the ability to implement the display in grey scale mode by controlling the voltage supplied to the control grid which, in turn, modulates emissions of electrons from the cathode to the anode, thus varying photon emission of the phosphor material deposited on the anode.

The grid is supported by a layer of dielectric material. The dielectric material is anisotropically etched to eliminate dielectric material between the cathode and its corresponding aperture. This results in the existence of a plurality of mushroom-shaped structures of dielectric material supporting the grid layer. In the alternative the dielectric layer can be isotropically etched until the mushroom-shaped structures are etched away, leaving the grid locally suspended. This results in an air-bridge structure.

Some of the advantages of the present invention include low power consumption, high brightness and low cost. Additionally, the cathode assembly of the present invention is less complicated and less expensive to manufacture since sophisticated photolithography is not required to produce the preferred flat cathode arrangement and grid assembly.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily used as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
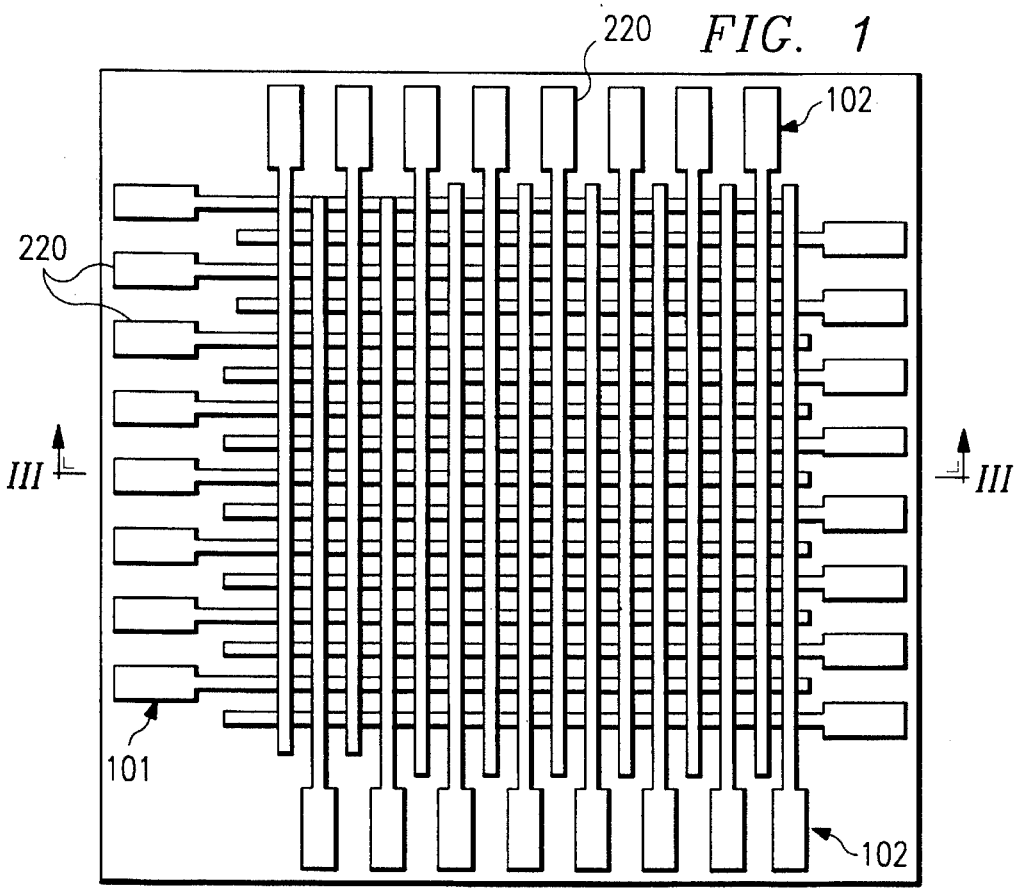
FIG. 1 illustrates a top view of joined cathode and extraction grid assemblies.

Turning now to FIG. 1, shown is a top view of joined cathode and extraction grid assemblies of the present invention. Their structure and function will be more completely described in a description pertaining to FIG. 2. The grid structure 102 is divided into electrically isolated and individually addressable strips which are arranged in a perpendicular manner with cathode strips, which, together, form a cathode structure 101. The cathode strips are parallel to anode strips (not shown). In this orthogonal arrangement, the strips in the structures 101, 102 provide a vertically and horizontally addressable structure which forms the basis for a flat panel display. External connectors 220 provide electrical access to the cathode structure 101 and the grid structure 102. In the preferred embodiment of the present invention, the cathode strips and grid strips are separated by a dielectric layer.

Figure 2:
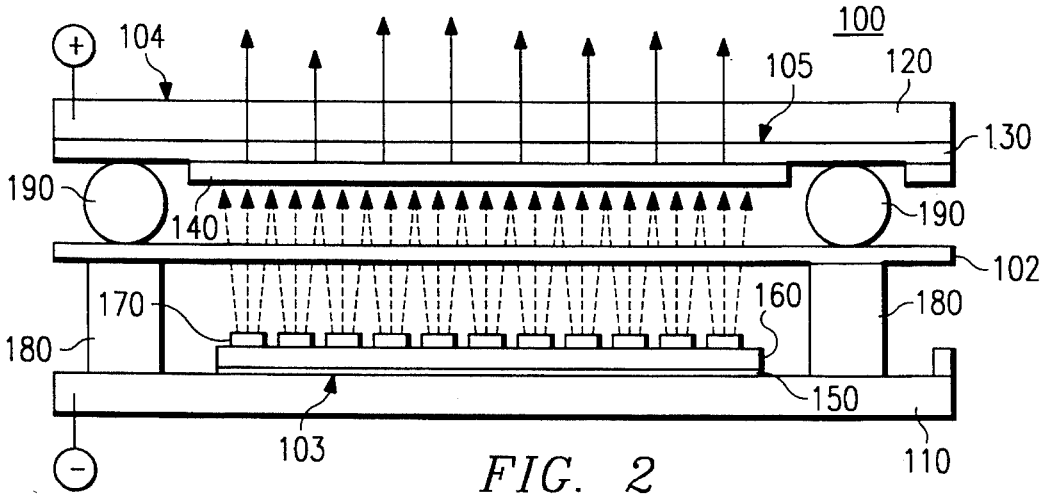
FIG. 2 illustrates a cross-sectional side view of a triode display.

Turning now to FIG. 2, shown is a side view of a "pixel" 100 of a triode flat panel display of the present invention. Each cathode strip 103 of the cathode structure 101 of FIG. 1 comprises a substrate 110, a conductive layer 150, a resistive layer 160 and flat cathodes 170. The individual flat cathodes 170 are spaced apart from each other resulting in their isolation maintained by the resistive layer 160. The anode assembly 104 consists of a substrate 120, typically glass, a conductive layer 130, typically indium-tin oxide (ITO) and a low energy phosphor 140, such as zinc oxide (ZnO). However, if a color display is desired, then red, green and blue phosphors can be substituted for the ZnO. The anode assembly 104 is separated from a grid structure 102 by a plurality of dielectric spacers 190, which maintain a desired distance of separation between the anode assembly 104 and the grid structure 102.

Interspersed between the cathode strips 103 and anode assembly 104 is the grid structure 102. Electrons passing through openings in the grid structure 102 are accelerated toward the conductive layer 130, striking the low energy phosphor 140 and causing the low energy phosphor to emit light in response thereto. The grid structure 102 is separated from a substrate under the cathode strips 103 by a spacer 180 which, in the preferred embodiment of the present invention, is a layer of dielectric material, preferably silicon dioxide ($SiO_2$). As will be explained later, apertures will be etched through the grid structure and the $SiO_2$ to form a channel from the cathodes, through corresponding apertures in the grid structure and to the corresponding anodes.

The pixel 100 is illuminated when a sufficient driver voltage is applied between the conductive layer 150 associated with the pixel 100 and the grid structure 102 corresponding to that particular pixel 100. The two driver voltages combine with the constant DC supply voltage to provide a sufficient threshold potential between the sections of the grid and cathode structures 102, 101 (both of FIG. 1) associated with the pixel 100. The threshold potential results in electron emission from the flat cathodes 170.

Figure 10:
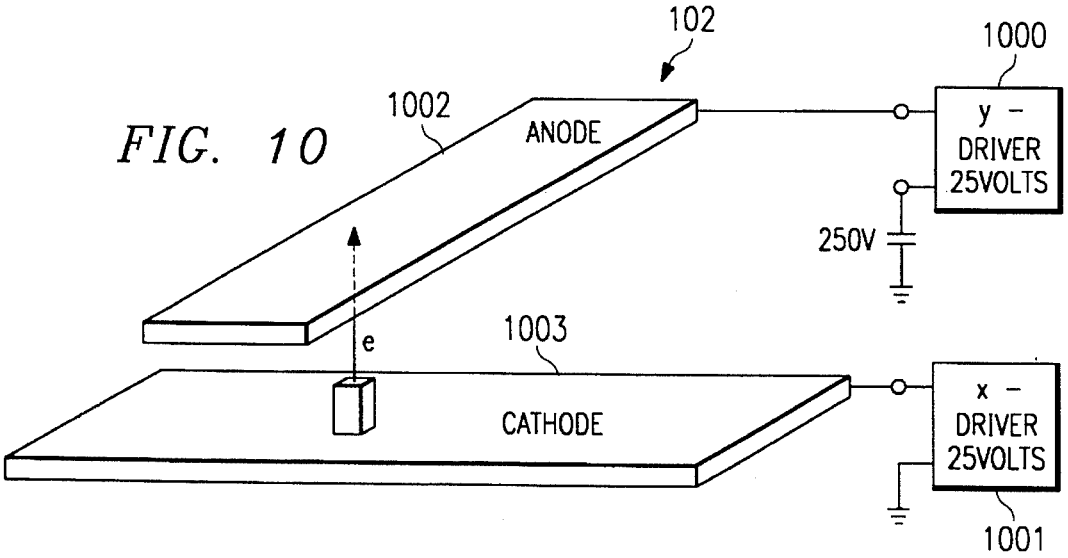
FIG. 10 illustrates a selective activation of a pixel site.

Referring next to FIG. 10, a biasing circuit is shown in order to drive a pixel in the display with an operating voltage of 300 volts by using voltage drivers 1000, 1001. One strip 1002 of grid structure 102 is shown. The pixel (intersection of grid strip 1002 and cathode strip 1003) is addressed by addressing either cathode strip 1003 or grid strip 1002, which lie orthogonally to each other. Cathode strip 1003 is addressed by 25 volt driver 1001 and grid strip 1002 is addressed by 25 volt driver 1000 which floats on a 250 volt DC power supply. The output voltage from the DC power supply is chosen to be slightly below the threshold voltage of the pixel. For example, for a display pixel with a threshold voltage of 300 volts. The 250 volt DC power supply is used.

Figure 3:
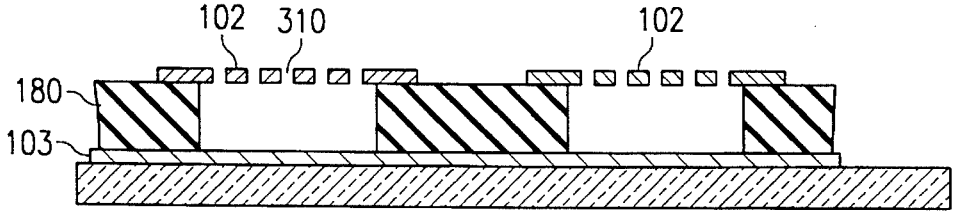
FIG. 3 illustrates a partial side view of the joined cathode and extraction grid assemblies of FIG. 2.

Turning now to FIG. 3, shown is a partial side view of the joined cathode and extraction grid assemblies of FIG. 2, taken along Section III—III of FIG. 1. In the embodiment shown in FIG. 3, spacers 180 are provided to maintain the proper distance between the grid structure 102 and the substrate under the cathode strips 103. Again, the spacers 300 are preferably a layer of dielectric material. The grid structure 102 is provided with a plurality of apertures 310 therein, the apertures aligned or to be aligned with corresponding cathodes (not shown).

Figure 4:
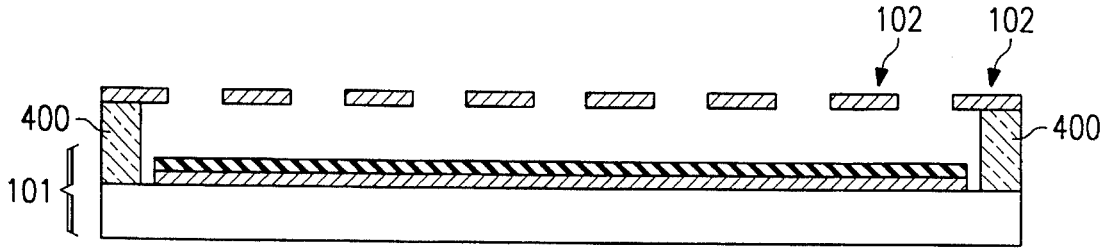
FIG. 4 illustrates a partial side view of an emitter array without supporting pillars before cathode deposition.

Turning now to FIG. 4, shown is a partial side view of an emitter array without supporting pillars before cathode deposition. The emitter array comprises the substrate, cathode conductive layer and resistive layer, all illustrated and described in detail with respect to FIG. 1. An $SiO_2$ dielectric layer 400 is deposited over the substrate and provides a base for an extraction gate conductive layer 102. As shown in FIG. 4, layer 102 has already been deposited on layer 400 and apertures photolithographically etched therein. Since FIG. 4 is a cross-section, the apertures are shown as spaces in the layer 102. Once the apertures have been etched, the $SiO_2$ layer is isotropically etched until it is removed from under that part of the layer 102 which is between the dielectric layer 400. Because a plurality of gate apertures corresponding to a particular pixel are closely spaced in the region of the pixel, isotropic etching of the $SiO_2$ layer results in an air-bridge structure wherein the layer 102 is locally suspended over the pixel, without support from pillars therein. Even though a particular pixel comprises a plurality of cathodes and gate apertures in the preferred embodiment of the present invention, the layer 102 is still supported on all sides around the pixel by the layer 400, as shown in FIG. 4. Note in particular, however, that the isotropic etch of the $SiO_2$ results in the layer 102 being etched back somewhat from the edges of the various apertures. This is an important feature of the present invention and will be explained in detail with respect to FIG. 5.

Figure 5:
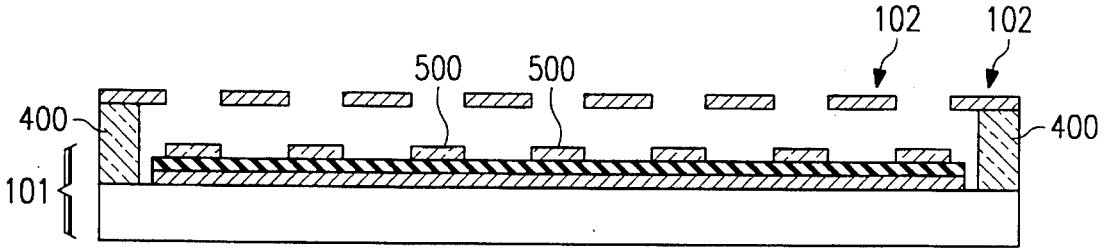
FIG. 5 illustrates a partial side view of an emitter array without supporting pillars after cathode deposition.

Turning now to FIG. 5, shown is a partial side view of an emitter array without supporting pillars after cathode deposition. Cathodes 500 are shown as having been deposited through the apertures and on the resistive layer. It is important to note that the cathodes are as wide as the apertures in the grid structure. It is a key feature of the present invention that the cathodes lie entirely under the apertures. This is so that the electric field existing about a cathode by virtue of the grid is relatively uniform over the surface of the cathode. This results in even electron emission over the surface. Furthermore, since no part of the cathodes lie directly under the grid, electrons, once emitted, do not have a tendency to strike the grid instead of the anode. This results in greater display efficiency, because power is not wasted on electrons which will fall to strike the anode.

Figure 6:
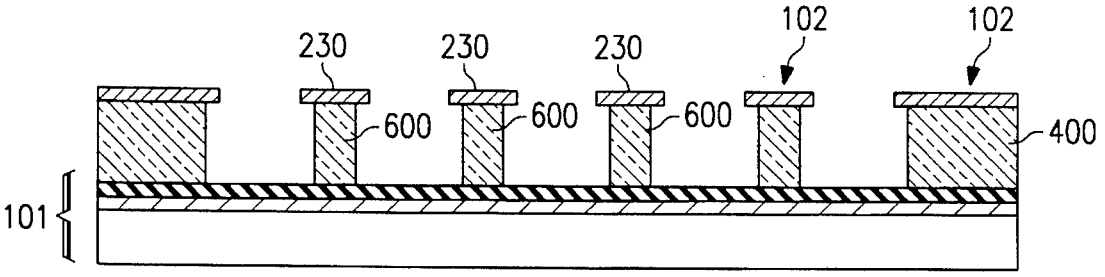
FIG. 6 illustrates a partial side view of an emitter array with supporting pillars before cathode deposition.

Turning now to FIG. 6, shown is a partial side view of an emitter array with supporting pillars before cathode deposition. Once apertures are etched in the grid layer 102, the $SiO_2$ dielectric layer 400 underneath is anisotropically etched until all $SiO_2$ is etched away from under the apertures. This leaves a plurality of mushroom-shaped pillars 600 between the individual apertures.

Figure 7:
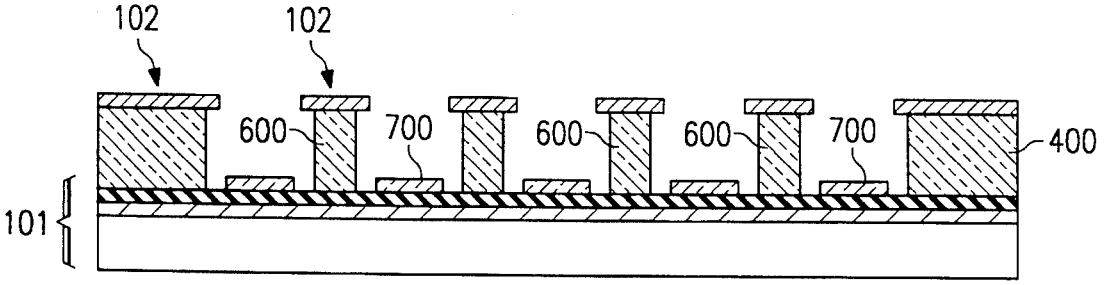
FIG. 7 illustrates a partial side view of an emitter array with supporting pillars before cathode deposition.

Turning now to FIG. 7, shown is a partial side view of an emitter array with supporting pillars after cathode deposition. It is important to note that the cathodes 700 are as wide as the apertures in the grid layer. It is also important to note that the pillars 600 are etched somewhat back from the edges of the apertures in the grid layer. Recall, as in the case of FIG. 5, that the cathodes deposited are of the same diameter as the apertures. It is highly undesirable to allow the dielectric layer to touch the cathodes 700 directly (thereby creating a "triple junction" of cathode, $SiO_2$ and space), otherwise electrons emitted from the cathodes 700 have a tendency to climb the walls of the dielectric layer, creating a low resistance path and inhibiting emission of electrons to the corresponding anode. This, as in the case described above, results in display inefficiency. Therefore, by providing a dielectric layer etched back from the apertures and thus removed by a small distance from the cathode, this phenomenon is minimized.

The method of depositing the cathodes 700 through the apertures in the grid conductive layer, using the grid conductive layer as a mask, is the preferred manner of producing the present invention. In an alternative method to that illustrated in FIGS. 4–7, the cathodes can be formed over the cathode conductive layer prior to deposition of the dielectric layer and the grid conductive layer, instead of depositing the cathodes through apertures in the grid conductive layer. One disadvantage of this alternative method, however, is that careful attention must be paid to alignment of the cathodes with respect to the apertures in the grid conductive layer. Should misalignment occur, display inefficiency or inoperability might result.

Figure 8:
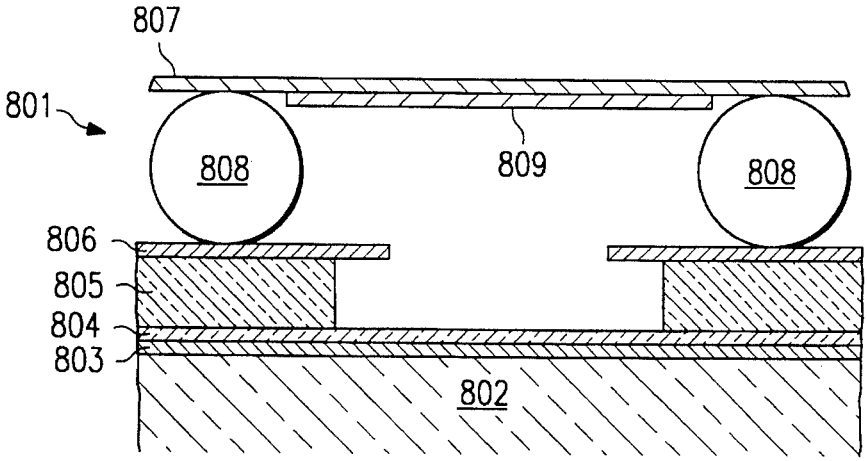
FIG. 8 illustrates an ineffective grid structure.

Turning now to FIG. 8, shown is an ineffective grid structure. The structure, generally designated 801, comprises a cathode substrate 802, upon which is deposited a cathode conductive layer 803 and strips of a cathode emission material layer 804. A dielectric layer 805 is deposited on the material layer 804 to form strips which are oriented so as to be perpendicular to the strips of cathode emission material and etched to form apertures which define individual cathode-anode pairs. A grid layer 806 of conductive material is next deposited on the dielectric layer 805, the grid layer 806 formed in strips corresponding to those of the dielectric layer 805 and having corresponding apertures therein. An anode assembly 807 comprising a phosphor layer 809 is placed above the grid layer 806 and held a controlled distance from the grid layer by a plurality of fibrous dielectric spacers 808.

Although the structure 801 is compatible with flat cathodes, it has several disadvantages. First, the electric field under the grid layer 806 is much higher than the field existing between the grid layer 806 strips. As previously mentioned, this results in many of the emitter electrons being directed, not to the anode 807, but to the grid layer 806. Since these electrons never strike a phosphor, the energy in them is wasted.

Second, the ratio of the electric field at and in the apertures in the grid layer 806 strips depends upon the diameter of the grid layer 806 apertures and the thickness of the dielectric layer 805. For good display operation, the diameter of the apertures and the thickness of the dielectric layer 805 should have, at most, a one-to-one correspondence. In the preferred embodiment of the present invention, the size of the apertures is approximately 1 to 20 micrometers in diameter.

Third, the fact that the emission layer 804 extends fully across the aperture gives rise to excess emission from the parts of the emission layer proximate the dielectric material (at the "triple junction"). In other words, emission from the emission layer 804 is not uniform from one side to another. It is much stronger on the edges of the cathode. This gives rise to leakage currents along the surface of the dielectric layer 805, causing the emission layer 804 and the grid layer 806 to short across the dielectric layer 805, thereby hampering or totally disabling operation of the pixel. Thus, the structure 801 is deficient.

The key difference between the structure of FIG. 8 and those preferred structures shown in FIGS. 5 and 7 is that the emission layer 804 is a uniform layer having triple junctions, whereas individual cathodes are shown in FIGS. 5 and 7, the cathodes having been deposited through the gate apertures or previously deposited in alignment with the apertures. In either case, the cathodes reside directly underneath the apertures and do not extend to under the gate conductors, which has been previously described as disadvantageous and is evident in FIG. 8.

Furthermore, in the case of FIG. 7, wherein mushroom-shaped $SiO_2$ dielectric supports exist between the individual cathodes, the dielectric supports are separated from the cathodes so as to eliminate triple junctions and thereby reduce the occurrence of surface current leakage. These emitters do not extend from one side to another of the aperture formed into the grid layer and thus do not come into contact with the dielectric layer, thereby minimizing the occurrence of leakage currents. Instead the cathodes are discrete units, deposited separately upon the conductive layer.

Figure 9:
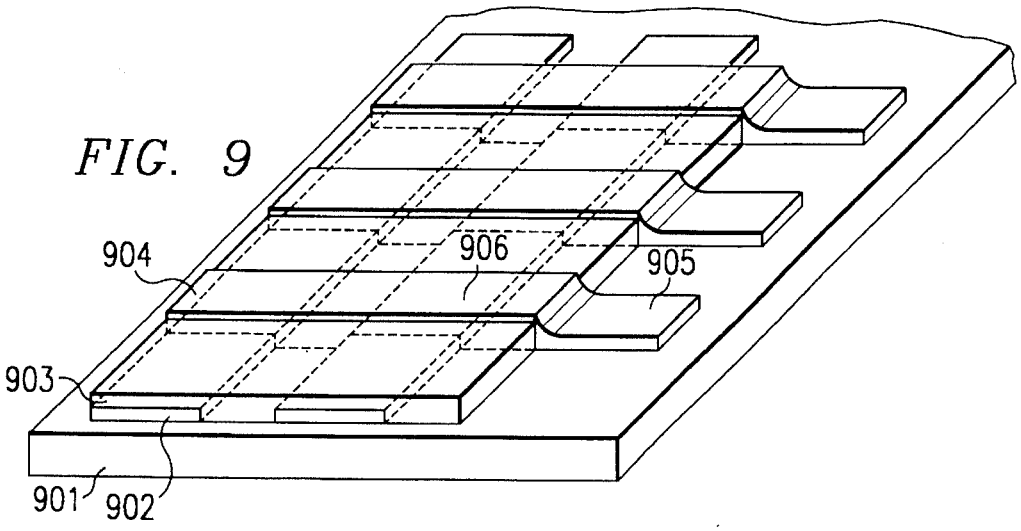
FIG. 9 illustrates a perspective view of the joined cathode and extraction grid assemblies with an intervening dielectric layer.

Turning now to FIG. 9, shown is a perspective view of the joined cathode and extraction grid assemblies with an intervening dielectric layer. Shown is a substrate 901 upon which is deposited a conductive layer 902, as described before. The conductive layer 902 is deposited in strips, as shown. A dielectric layer 903 is deposited in a blanket layer over the conductive layer 902 and portions of the substrate 901. Next, a control grid layer 904 is deposited on the dielectric layer 903 in the form of strips oriented perpendicularly with respect to the conductive layer 902 strips and provided with a plurality of apertures corresponding to those in the dielectric layer 903. A plurality of apertures 906 are formed in the dielectric layer 903 which correspond to cathodes created or to be created in the conductive layer 902. The grid layer 904 terminates in a plurality of end conductors 905 which can be coupled to drive circuitry allowing the grid layer 904 to be selectively potentially separated from the conductive layer 902. For purposes of FIG. 9, the anode layer and fibrous spacing material have not been shown although, if shown, would reside over the grid layer 904.

From the above description, it is apparent that the present invention is the first to provide a flat panel display comprising (1) a plurality of corresponding light-emitting anodes and field-emission cathodes, each of the anodes emitting light in response to emission from each of the corresponding cathodes, each of the cathodes including a layer of low work function material having a relatively flat emission surface comprising a plurality of distributed localized electron emission sites and (2) a grid assembly interspersed between the corresponding anodes and cathodes to thereby control emission levels to the anodes from the corresponding cathodes.

Although the present invention and its advantages have been described in detail, it should be understood that various changes, substitutions and alterations can be made herein without departing from the spirit and scope of the invention as defined by the appended claims.

What is claimed is:

1. A flat panel display, comprising:

a plurality of corresponding light-emitting anodes and field-emission cathodes, each of said anodes emitting light in response to electron emission from each of said corresponding cathodes, each of said cathodes including a layer of low work function material having a relatively flat exposed emission surface comprising a plurality of distributed localized electron emission sites located on said relatively flat exposed emission surface a distance away from edges of said relatively flat exposed emission surface; and a grid assembly positioned between said corresponding anodes and cathodes to thereby control emission levels to said anodes from said corresponding cathodes.

2. The display as recited in claim 1 wherein said layer of low work function material is amorphic diamond film.

3. The display as recited in claim 1 wherein said cathodes are joined together into a cathode assembly.

4. The display as recited in claim 3 wherein said cathode assembly comprises a plurality of cathode strips.

5. The display as recited in claim 4 wherein said grid assembly comprises a plurality of grid strips.

6. The display as recited in claim 5 wherein said grid strips are arranged in a perpendicular relationship with said cathode strips.

7. The display as recited in claim 1 wherein connectors coupled to said grid assembly are adaptable to provide electrical access to said grid assembly.

8. The display as recited in claim 3 wherein a dielectric layer is provided between said grid assembly and said cathode assembly to maintain a desired distance between said grid assembly and said cathode assembly.

9. The display as recited in claim 1 wherein each of said cathodes is a portion of a cathode assembly comprising:

a substrate:

an electrically resistive layer disposed over said substrate: and said layer of material having a low work function disposed over said resistive layer.

10. The display as recited in claim 1 wherein said grid assembly comprises a plurality of individually addressable grid elements, each of said grid elements corresponding to particular corresponding cathodes and anodes.

11. The display as recited in claim 10 wherein grid elements are selectively provided with an electrical potential.

12. A method of operation of a flat panel display, comprising the steps of:

electrically energizing a plurality of corresponding light-emitting anodes and field-emission cathodes, each of said anodes emitting light in response to electron emission from each of said corresponding cathodes, each of said cathodes including a layer of low work function material having a relatively flat exposed emission surface comprising a plurality of distributed localized electron emission sites located on said relatively flat exposed emission surface a distance away from edges of said relatively flat exposed emission surface; and positioning a grid assembly between said corresponding anodes and cathodes to thereby control emission levels to said anodes from said corresponding cathodes.

13. The method as recited in claim 12 wherein said layer of low work function material is amorphic diamond film.

14. The method as recited in claim 12 wherein said cathodes are joined together into a cathode assembly.

15. The method as recited in claim 14 wherein said cathode assembly comprises a plurality of cathode strips.

16. The method as recited in claim 15 wherein said grid assembly comprises a plurality of grid strips.

17. The method as recited in claim 16 wherein said grid strips are arranged in a perpendicular relationship with said cathode strips.

18. The method as recited in claim 12 wherein connectors coupled to said grid assembly are adaptable to provide electrical access to said grid assembly.

19. The method as recited in claim 14 wherein a dielectric layer is provided between said grid assembly and said cathode assembly to maintain a desired distance between said grid assembly and said cathode assembly.

20. The method as recited in claim 12 wherein each of said cathodes is a portion of a cathode assembly comprising:

a substrate;

an electrically resistive layer disposed over said substrate; and said layer of material having a low work function disposed over said resistive layer.

21. The method as recited in claim 12 wherein said grid assembly is provided with selectively addressable grid elements.

22. A flat panel display, comprising:

a plurality of discrete field-emission cathodes, each of said discrete cathodes including a layer of low work function material disposed to form a relatively flat exposed emission surface comprising a plurality of distributed localized electron emission sites located on said relatively flat exposed emission surface a distance away from edges of said relatively flat exposed emission surface; and a conductive layer disposed over said plurality of discrete cathodes, said conductive layer having apertures therein, each of said apertures corresponding to each of said discrete cathodes, edges of said apertures located substantially above edges of said discrete cathodes.

23. The display as recited in claim 22 wherein said layer of low work function material is amorphic diamond film.

24. The display as recited in claim 22 wherein said discrete cathodes are joined together into a cathode assembly.

25. The display as recited in claim 24 wherein said cathode assembly comprises a plurality of cathode strips.

26. The display as recited in claim 25 wherein said conductive layer is structured as a grid assembly comprising a plurality of grid strips.

27. The display as recited in claim 26 wherein said grid strips are arranged in a perpendicular relationship with said cathode strips.

28. The display as recited in claim 26 wherein connectors coupled to said grid assembly are adaptable to provide electrical access to said grid assembly.

29. The display as recited in claim 26 wherein a dielectric layer is provided between said grid assembly and said cathode assembly to maintain a desired distance between said grid assembly and said cathode assembly.

30. The display as recited in claim 22 wherein each of said cathodes is a portion of a cathode assembly comprising:

a substrate;

an electrically resistive layer disposed over said substrate; and said layer of material having a low work function disposed over said resistive layer.

31. The display as recited in claim 22 wherein grid elements are selectively provided with an electrical potential.

32. A flat panel display, comprising:

a plurality of discrete field-emission cathodes, each of said discrete cathodes including a layer of low work function material disposed to form a relatively flat exposed emission surface comprising a plurality of distributed localized electron emission sites located on said relatively flat exposed emission surface a distance away from edges of said relatively flat exposed emission surface;

a plurality of anodes corresponding to said plurality of cathodes, each of said anodes emitting light in response to electron emission from each of said corresponding cathodes; and a conductive layer disposed over said plurality of discrete cathodes, said conductive layer having apertures therein, each of said apertures corresponding to each of said discrete cathodes, edges of said apertures located substantially above edges of said discrete cathodes.

33. The display as recited in claim 32 wherein said layer of low work function material is amorphic diamond film.

34. The display as recited in claim 32 wherein said discrete cathodes are joined together into a cathode assembly.

35. The display as recited in claim 34 wherein said cathode assembly comprises a plurality of cathode strips.

36. The display as recited in claim 35 wherein said conductive layer is structured as a grid assembly comprising a plurality of grid strips.

37. The display as recited in claim 36 wherein said grid strips are arranged in a perpendicular relationship with said cathode strips.

38. The display as recited in claim 36 wherein connectors coupled to said grid assembly are adaptable to provide electrical access to said grid assembly.

39. The display as recited in claim 36 wherein a dielectric layer is provided between said grid assembly and said cathode assembly to maintain a desired distance between said grid assembly and said cathode assembly.

40. The display as recited in claim 32 wherein each of said discreet cathodes is a portion of a cathode assembly comprising:

a substrate;

an electrically resistive layer disposed over said substrate; and said layer of material having a low work function disposed over said resistive layer.

41. A flat panel display, comprising:

a plurality of corresponding light-emitting anodes and field-emission cathodes, each of said anodes emitting light in response to electron emission from each of said corresponding cathodes, each of said cathodes including a layer of low work function material having a relatively flat emission surface comprising a plurality of distributed localized electron emission sites, wherein said layer of low work function material is amorphic diamond film; and a grid assembly positioned between said corresponding anodes and cathodes to thereby control emission levels to said anodes from said corresponding cathodes.

42. A method of operation of a flat panel display, comprising the steps of:

electrically energizing a plurality of corresponding light-emitting anodes and field-emission cathodes, each of said anodes emitting light in response to electron emission from each of said corresponding cathodes, each of said cathodes including a layer of low work function material having a relatively flat emission surface, wherein said layer of low work function material is amorphic diamond film; and positioning a grid assembly between said corresponding anodes and cathodes to thereby control emission levels to said anodes from said corresponding cathodes.

43. A flat panel display, comprising:

a plurality of discrete field-emission cathodes, each of said discrete cathodes including a layer of low work function material disposed to form a relatively flat emission surface, wherein said layer of low work function material is amorphic diamond film; and a conductive layer disposed over said plurality of discrete cathodes, said conductive layer having apertures therein, each of said apertures corresponding to each of said discrete cathodes, edges of said apertures located substantially above edges of said discrete cathodes.

* * * * *